US006148552A

United States Patent [19]

Dumontier et al.

[11] Patent Number: 6,148,552

[45] Date of Patent: Nov. 21, 2000

[54] DEVICE FOR ROTATABLY DISPLAYING ADVERTISING MATERIAL

[76] Inventors: Raymond Dumontier, 76, rue du Grand Coteau, Ste-Julie (Québec), Canada, J0L 2S0; Gaétan Bertrand, 889, rue Pierre, Ste-Dorothée, Laval (Québec), Canada, H7X 3T2

[21] Appl. No.: 09/192,357

[22] Filed: Nov. 16, 1998

[51] Int. Cl.[7] ..... G09F 11/02

[52] U.S. Cl. ..... 40/473; 40/493; 40/502; 40/506

[58] Field of Search ..... 40/430, 431, 473, 40/493, 502, 503, 506

[56] References Cited

U.S. PATENT DOCUMENTS

| | | | |
|---|---|---|---|
| 1,099,879 | 6/1914 | Hutchings | 40/431 |
| 1,178,732 | 4/1916 | Koken | 40/431 |
| 1,688,317 | 10/1928 | Marschall | 40/431 |
| 1,875,049 | 8/1932 | Lewis | 40/430 |
| 2,069,103 | 1/1937 | Bestler | 40/431 |
| 2,204,435 | 6/1940 | Musaphia | 40/431 |
| 2,555,070 | 5/1951 | Wood | 40/473 X |
| 2,598,906 | 6/1952 | Green | 40/473 |
| 2,906,046 | 9/1959 | Graves | 40/473 |
| 3,039,615 | 6/1962 | Uihlein et al. | 40/473 X |
| 3,313,165 | 4/1967 | Evans | 40/473 X |
| 3,778,099 | 12/1973 | Rogove et al. | 40/473 X |
| 3,791,058 | 2/1974 | Mollica | 40/431 |
| 3,947,985 | 4/1976 | Skrzypczak | 40/473 |
| 5,572,816 | 11/1996 | Anderson, Jr. et al. . | |

FOREIGN PATENT DOCUMENTS

| | | | |
|---|---|---|---|
| 1093101 | 5/1955 | France | 40/473 |

*Primary Examiner*—Terry Lee Melius
*Assistant Examiner*—Andrea Chop
*Attorney, Agent, or Firm*—Swabey Ogilvy Renault

[57] ABSTRACT

The device comprises a base member, a transparent outer tubular member which is fixed to the base member. It also comprises a transparent inner tubular member and a revolving inner tubular member holder to mount the inner tubular member in spaced relationship with respect to the outer tubular member. The revolving member is mounted on the base member so as to permit rotation of the revolving inner tubular member holder and of the transparent inner tubular member. Mounting strips or the like are provided to mount translucid advertising sheets on the inner tubular member, and a lighting system is arranged to direct light against the translucid advertising material so as to enable the advertising material to be observed through the transparent tubular member. A container such as a waste box may be placed in the space provided inside the inner tubular member.

1 Claim, 7 Drawing Sheets

DEVICE FOR ROTATABLY DISPLAYING ADVERTISING MATERIAL

BACKGROUND OF THE INVENTION (a) Field of the Invention

This invention relates to a device for rotatably displaying advertising material. More particularly, the present invention is concerned with an arrangement wherein advertising material is continuously rotated, possibly displaying a plurality of advertisements, and which can also be used for waste disposal or the like.

(b) Description of the Prior Art

Advertising is a highly competitive process. The idea is to show as much as possible to the consumer and at the lowest cost. In addition it is essential that advertising takes place where a large number of people gather, such as in shopping arcades. It is of course well known that advertising panels of all kinds appear in these places, these panels being placed in locations to be seen by as many persons as possible. Rotating advertising signs are known such as disclosed in U.S. Pat. No. 5,572,816 which discloses an array of revolving display louvers. This device is structurally complex and is not fit to be placed in locations where it may be seen or contacted by the general public.

There is therefore a need for a device which continuously displays a plurality of advertisements, which can be placed in close proximity where the public circulates and which may also be used for other purpose such as a waste box or the like.

SUMMARY OF INVENTION

It is an object of the present invention to provide a device which rotatably displays a plurality of advertisements, which is inexpensive to manufacture and which can further be used for other purposes.

The above and other objects of the invention may be provided by providing a device for rotatably displaying advertising material, which comprises a base member, a transparent outer tubular member, and means for fixedly mounting the transparent outer tubular member on the base member, a transparent inner tubular member, a revolving inner tubular member holder, and means for mounting the transparent inner tubular member on the revolving inner tubular member holder inwardly spaced from the transparent outer tubular member, means for mounting the revolving inner tubular member in the base member, so as to permit rotation of the revolving inner tubular member holder and of the transparent inner tubular member, and means for mounting advertising material on the transparent inner tubular member.

In accordance with a preferred embodiment, there is provided a device for rotatably displaying advertising material, which comprises a base member, a transparent outer tubular member, and means for fixedly mounting the transparent outer tubular member on said base member, a transparent inner tubular member, a revolving inner tubular member holder, and means for mounting the transparent inner tubular member on the revolving inner tubular member holder inwardly spaced from the transparent outer tubular member, means for mounting the revolving inner tubular member on the base member, so as to permit rotation of the revolving inner tubular member holder and of the transparent inner tubular member, means for mounting translucid advertising material on the transparent inner tubular member, and lighting means mounted to direct light against the translucid advertising material so as to enable the advertising material to be observed through the transparent outer tubular member, In accordance with a preferred embodiment, the base member comprises a circular plate provided with an upstanding continuous peripheral flange, a lower portion of the transparent outer tubular member being mounted interiorly relative to the peripheral flange to be snugly engaged therewith.

In accordance with another embodiment, the revolving inner tubular member holder is ring shaped into an outer channel adapted to receive a lower end of the transparent inner tubular member, and a vertical guide which enables the tubular member holder to continuously rotate around a central axis of the device.

Preferably, the ring shaped inner tubular member holder has an inner horizontal portion, the vertical guide protruding from an inner end of the inner horizontal portion, the latter extending into a downward angular portion which is terminated at an outer end by the outer channel.

In accordance with another preferred embodiment, the device according to the invention comprises a plurality of wheel brackets mounted on the circular plate, each wheel bracket to mount a freely rotable vertical support wheel and a freely rotatable horizontal abutment wheel, the vertical support wheel being disposed to rotatably ride underneath the inner horizontal portion of the ring shaped inner tubular member holder to support same when the latter is rotating, the freely rotatable horizontal abutment wheel to rest against the vertical guide, to enable the ring shaped inner tubular member holder to continuously rotate around the central axis of the device.

Preferably, an articulated arm and driving wheel bracket is fixedly mounted on the circular plate and a driving wheel is mounted on the driving wheel bracket to drivingly engage an underface of the inner horizontal portion, the driving wheel being operatively connected to an electrical motor to rotate the ring shaped tubular member holder and the inner tubular member.

In accordance with yet another embodiment, the device according to the invention comprises a motor bracket mounted on the circular plate, the electrical motor being disposed on the motor bracket, an articulated arm is fixed at one end to the articulated arm and driving wheel bracket, the other end of the articulated arm having means to mount the freely rotatable engagement wheel, and a coil spring is disposed between the motor bracket and the articulated arm to bias the engagement wheel against the upper face of the inner horizontal portion of the ring shaped inner tubular member holder.

The device according to the invention preferably comprises a bottom support and a tubular wall mounted on the bottom support, a bottom support rest fixedly mounted on the circular plate, the bottom support tubular wall combination being mounted on the bottom support rest and dimensioned to be spacedly disposed within the inner tubular member, the lighting means are mounted exteriorly on the tubular wall to be directed towards the inner tubular member and the translucid advertising material mounted thereon.

The device may comprise a circular stand, and the circular plate is mounted on the circular stand.

The device may also comprise a waste box disposed within the tubular wall to rest on the box rest in the space provided by the tubular wall and the box rest, and a cover over the waste box.

The lighting means preferably comprise fluorescent lamps.

The device according to the invention may also comprise a control box having a first switch to operate the electrical motor and a second switch to open the lighting means.

BRIEF DESCRIPTION OF DRAWINGS

The invention will now be illustrated by means of a preferred embodiment which is given by way of illustration only and without limitation, wherein.

DESCRIPTION OF PREFERRED EMBODIMENT

Figure 1:
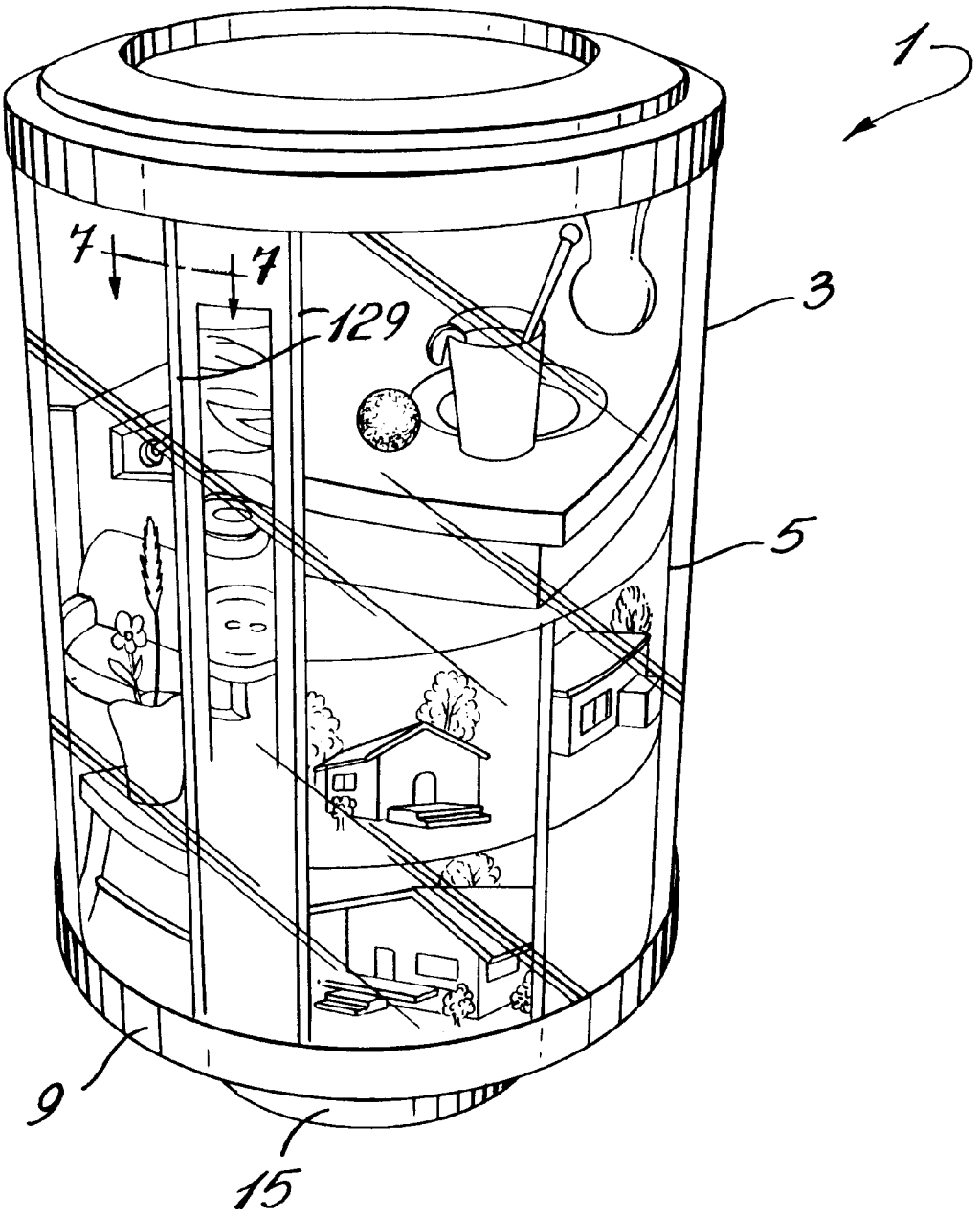
FIG. 1 is a perspective view of a device according to the invention.
Figure 2:
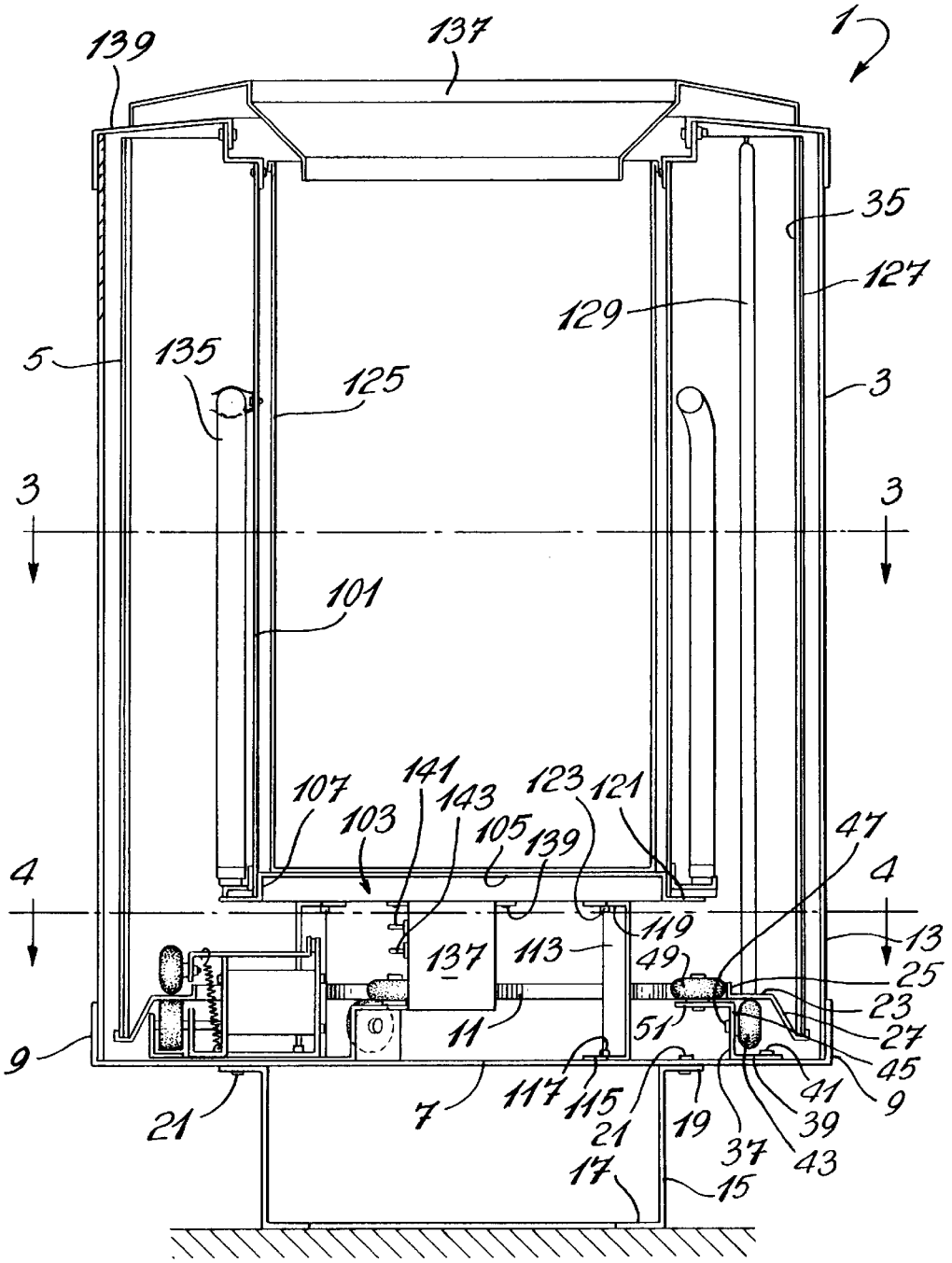
FIG. 2 is a cross-section view in elevation of the device illustrated in FIG. 1.
Figure 3:
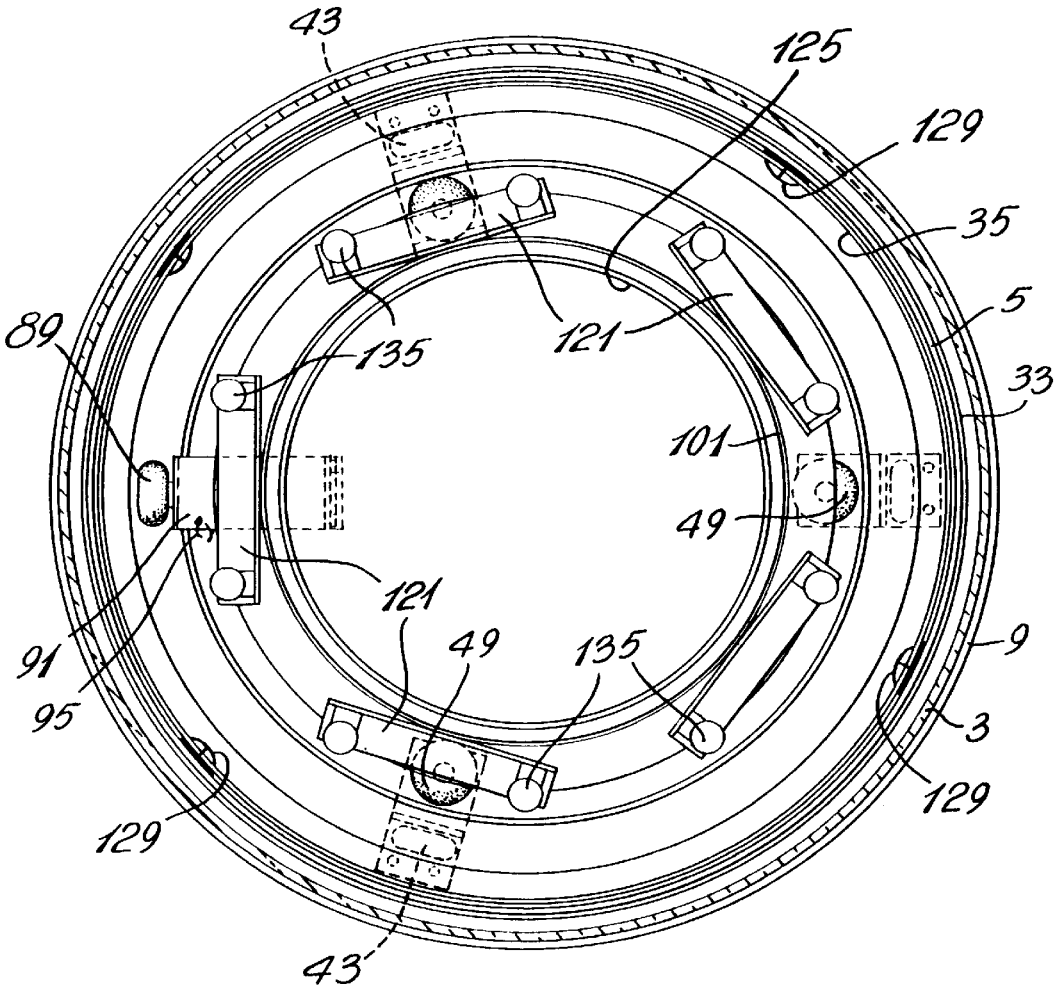
FIG. 3 is a transverse cross-section view along line 3—3 of FIG. 2.
Figure 4:
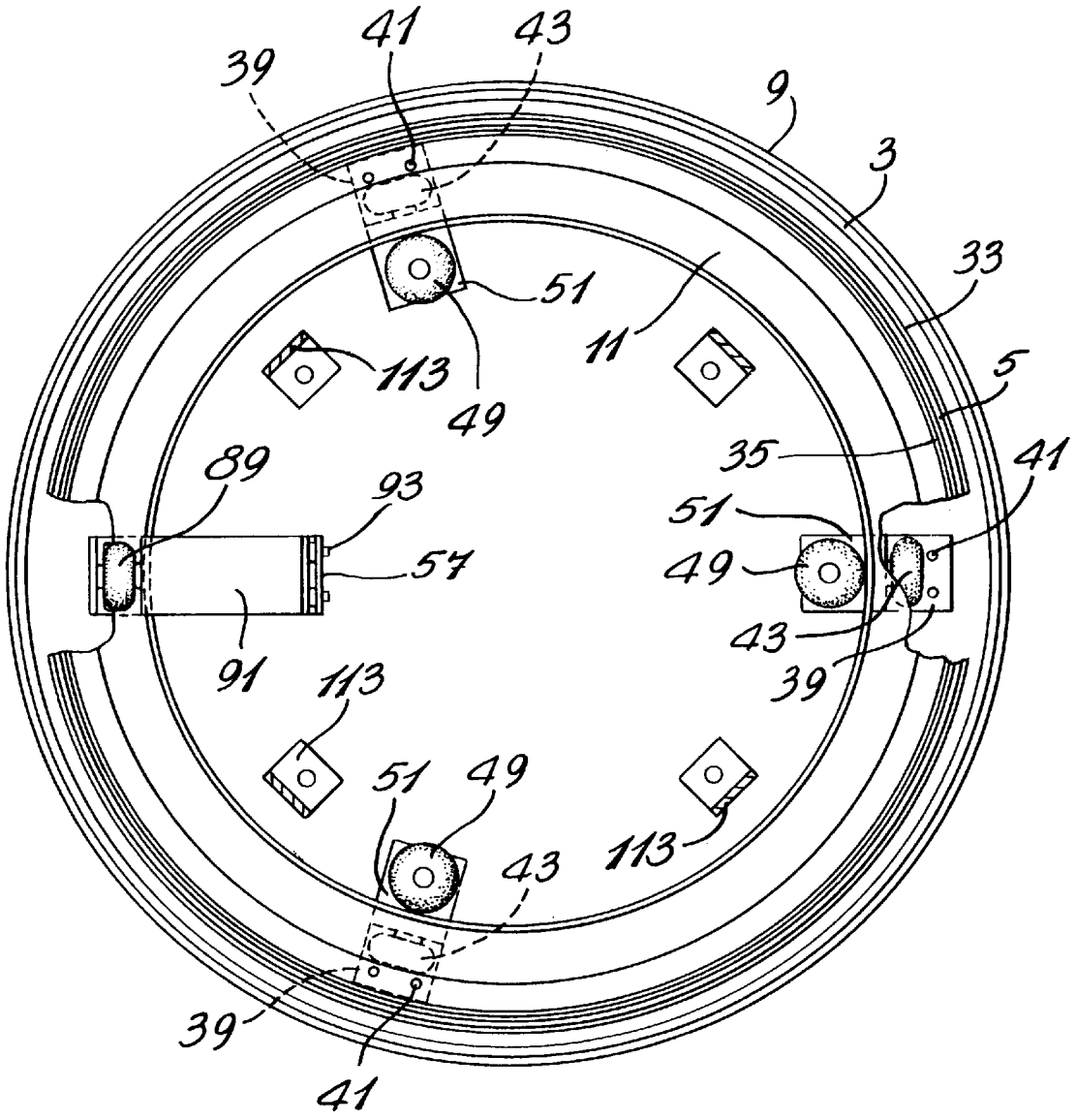
FIG. 4 is a transverse cross-section view along line 4—4 of FIG. 2.
Figure 5:
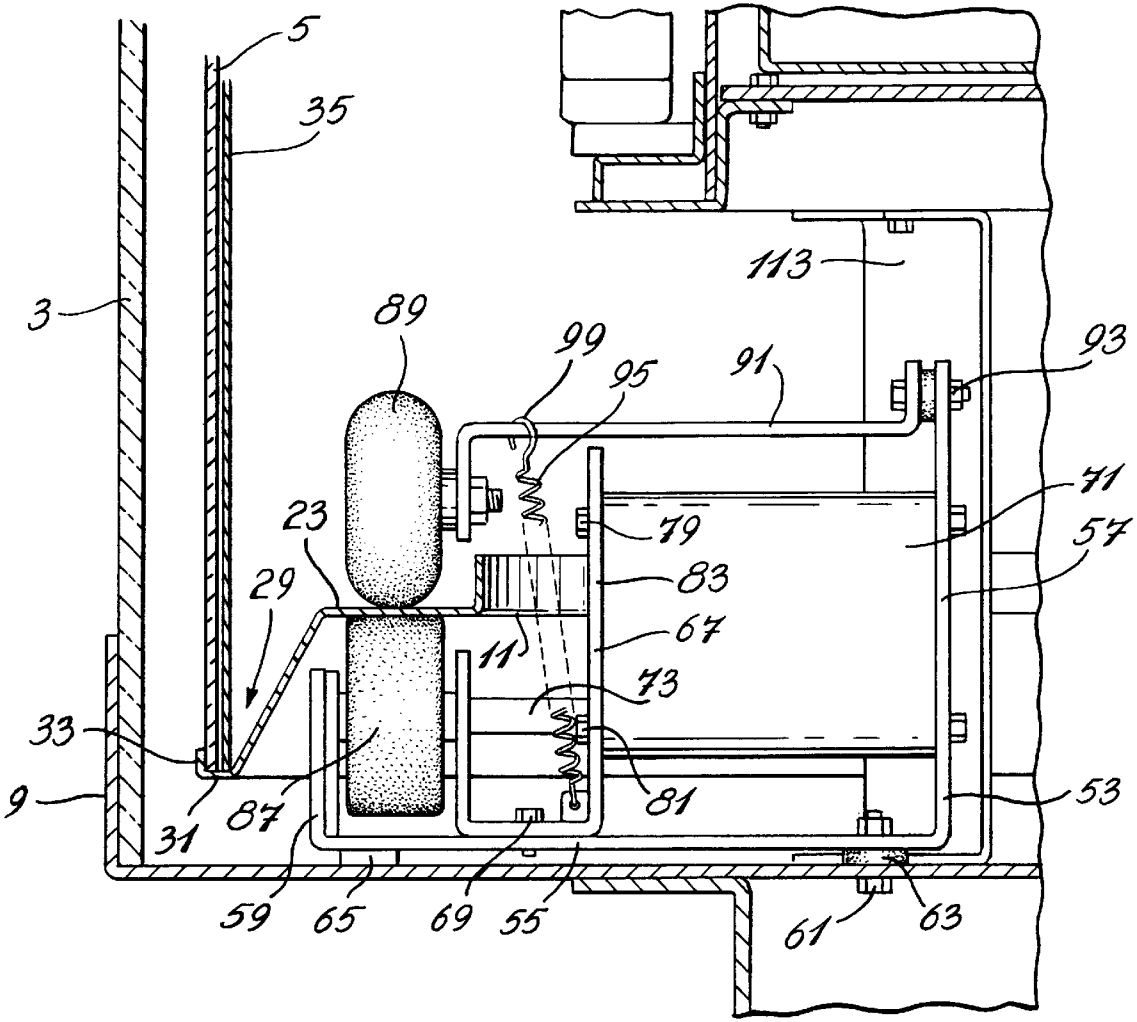
FIG. 5 is a cross-section view in elevation showing the driving wheel and the engagement wheel in contact with the ring shaped inner tubular member holder, and the driving motor.

With reference to the drawings, more particularly FIGS. 2 and 5, it will be seen that the device 1 for rotatably displaying advertising material, which is illustrated, comprises a transparent outer tubular member 3, transparent inner tubular member 5, a circular plate 7 having an outer peripheral flange 9, and a revolving ring shaped inner tubular member holder 11.

More particularly, for convenience and cost, both outer tubular member 3 and inner tubular member 5 are made of transparent material, such as plastic or any material known to those skilled in the art, the choice of which is entirely left to one skilled in the art. As shown, tubular members 3 and 5 are spaced from one another a certain convenient distance, the purpose of which will be discussed more in detail later. Furthermore, as particularly seen in FIG. 2, outer tubular member 3 is slightly longer than inner tubular member 5, mainly because their respective lower ends are mounted at different levels as will be seen later.

Circular plate 7 which constitutes the base of the device is preferably metallic, such as aluminum, however any other soluble material can be used as will be appreciated by one skilled in the art. The lower portion 13 of transparent outer tubular member 3 is mounted interiorly relative to peripheral flange 9 so as to be snugly engaged therewith as shown particularly in FIGS. 2 and 5. Circular plate 7 is mounted on a circular stand 15 as shown, which consists of a short tubular structure, which may be metallic, such as aluminum, or any other suitable material as is well known to one skilled in the art. This short tubular structure is formed with an inwardly turned flange 17, which may enable it to be fixed on a floor, by any known means, and an outwardly turned flange 19 which permits to fix the stand to circular plate 7 by means of nuts and bolts 21.

Referring again to FIGS. 2 and 5 for a description of ring shaped inner tubular member holder 11, it will be seen that the latter is in the form of a circumferential member wherein the ring portion consists of an inner horizontal portion 23 which is inwardly terminated by a vertical guide 25 which protrudes at the inner end of horizontal portion 23. It will also be seen that the horizontal portion outwardly extends into a downward angular portion 27 which is terminated at the outer end by an outer channel 29. As shown, the later consists of a short horizontal portion 31 located at a lower level than horizontal portion 23, and an upturned flange 3. It will of course be understood that horizontal portion 31 and upturned flange 33 are dimensioned so as to exactly engage the lower ends respectively of transparent inner tubular member 5 and a sheet of translucid advertising material 35 which will be described later in more detail. Ring shaped inner tubular member holder 11 is mounted to rotate by means of a system of wheels that will now be described.

Referring once again to FIGS. 2 and 5, the device according to the invention comprises a plurality of Z-shaped wheel brackets 37 (in the illustrated embodiment, three are used although any suitable number may be provided as will be appreciated by one skilled in the art). Of course, other shape of brackets can be used instead of Z-shaped brackets 37, as will be appreciated by one skilled in the art. These Z-shaped brackets are fixedly mounted at their lower horizontal leg 39, such as by nuts and bolts 41, on circular plate 7, as shown. A freely rotatable vertical support wheel 43, which is well known to those skilled in the art, is mounted on vertical leg 45 in known manner such as by a threaded shaft (not shown) secured by means of nut 47. Finally, a freely rotatable horizontal abutment wheel 49 is mounted similarly as wheel 43, on upper horizontal leg 51 of Z-shaped wheel bracket 37.

To complete the wheel system that is used to support and rotate ring shaped inner tubular member holder 11, reference will particularly be made to FIG. 5, which inter alia illustrates the arrangement used to rotate tubular member holder 11. An articulated arm and driving wheel bracket 53 consisting of a horizontal portion 55, a longer right hand vertical portion 57 and a shorter left hand vertical portion 59 is spacedly mounted on circular plate 7 by means of nuts and bolts 61 (or other known fixing means). The space just mentioned is provided between circular plate 7 and motor bracket 53 by disposing washer 63 between bracket 53 and circular plate at the level of nuts and bolts 61. At the other end of horizontal portion 55, the above space is provided by disposing a pad 65 as shown. Additionally, an L-shaped motor bracket 67 is mounted over horizontal portion 55 as shown by bolting it at 69, and motor 71 provided with driving shaft 73 is bolted at 79, 81 on longer vertical portion 83 of L-shaped motor bracket 67.

At the end of driving shaft 73, a driving wheel 87 is fixedly mounted thereon and is supported by shorter vertical portion 59 to rotate therein. Driving wheel 87 is exactly at the same level as vertical support wheel 43 so as to ensure that ring shaped inner tubular member holder 11 is always perfectly horizontal. For this purpose, driving wheel 87 is always in operative contact with the underface of horizontal portion 23 of inner tubular member holder 11.

To ensure that horizontal portion 23 remains in operative contact with driving wheel 87, there is provided an engagement wheel 89 which is urged against the upper face of horizontal portion 23 of inner tubular member holder 11. To achieve this, an articulated arm 91 is articulated mounted at one end by means of a loose nut and bolt arrangement 93 at the top of vertical portion 57 of bracket 53. Engagement wheel 89 is mounted as shown at the other end of articulated arm 91 to freely rotate while in contact with the upper face of horizontal portion of inner tubular member holder 11. To ensure that driving wheel 89 presses against horizontal portion 23 of inner tubular member holder 11, there is provided a coil spring 95 which is fixed at one end to L-shaped bracket 67 as shown and is hooked at 99 over articulated arm 91. When the motor operates, the ring shaped inner tubular member holder 11, while being supported perfectly horizontally by support wheels 43 and driving wheel 87, will rotate consistently relative to the axis of the device by being guided with vertical guide 25 and horizontal abutment wheels 49.

Figure 6:
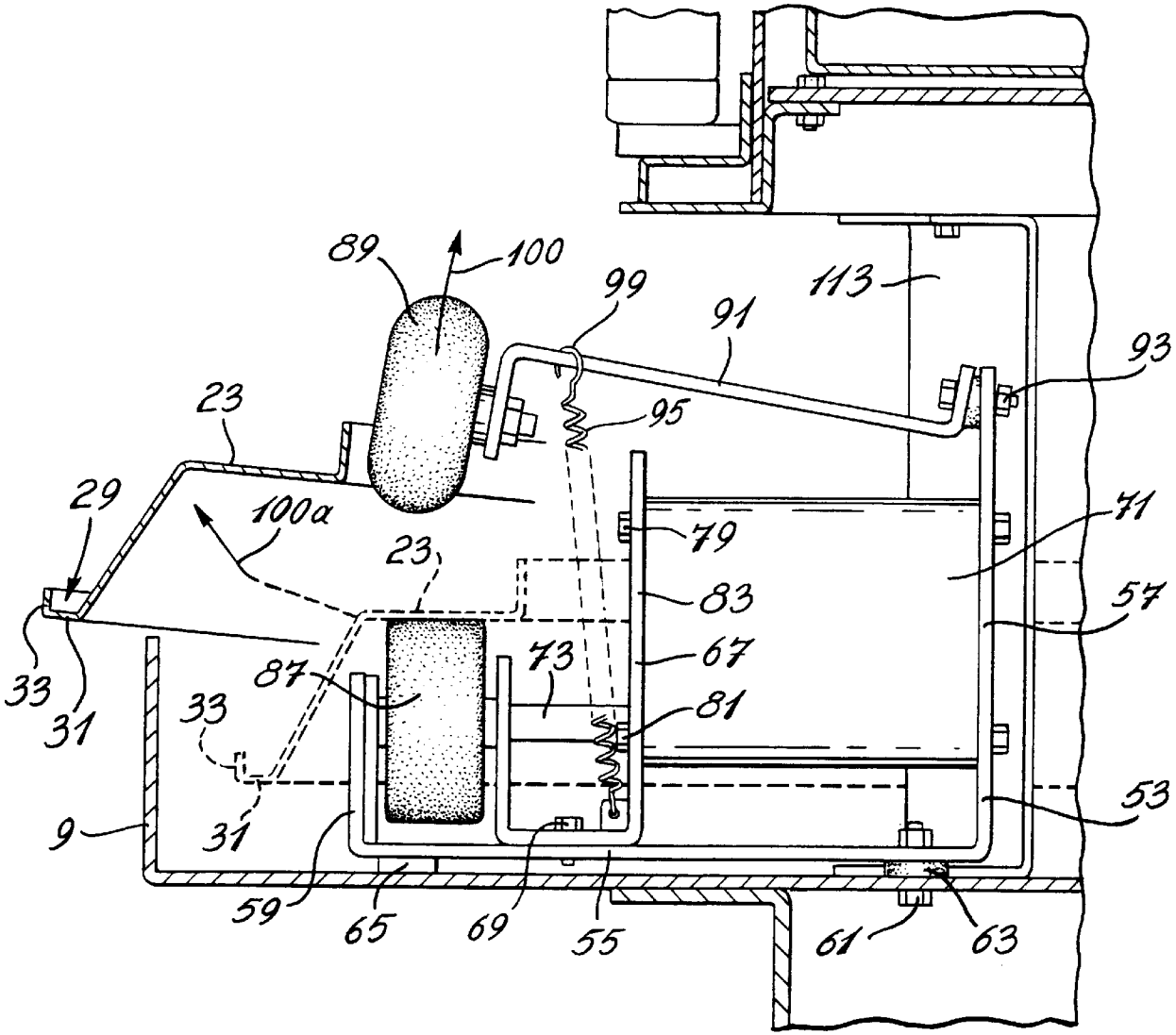
FIG. 6 is a view similar to FIG. 5 showing the removal of the ring shaped inner tubular member holder by disengaging engagement wheel and moving out the inner tubular member holder.
Figure 7:
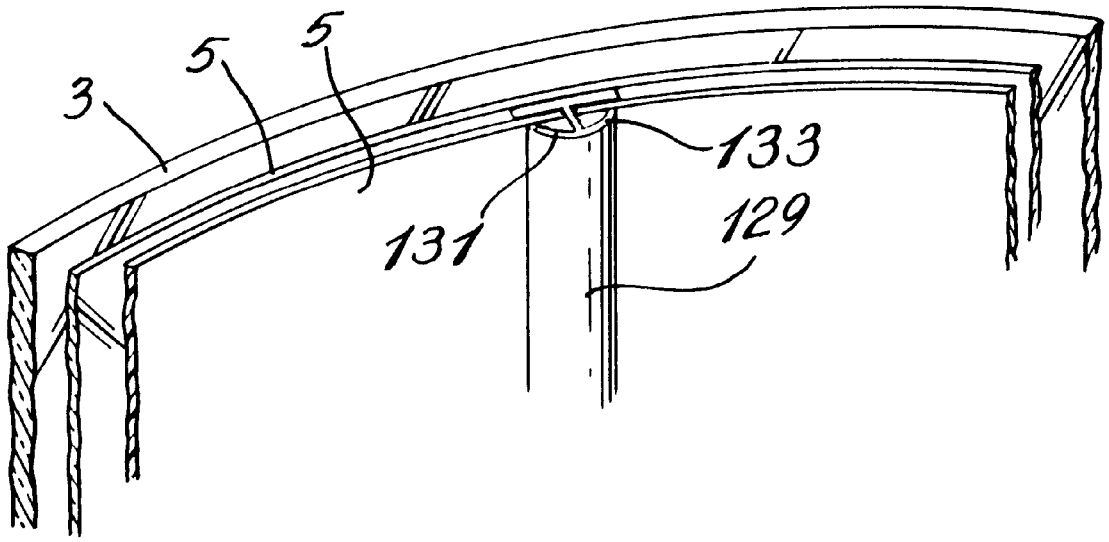
FIG. 7 is a partial perspective view showing the strip used to mount advertising sheets on the inner tubular member.

As shown in FIG. 6, it will be seen that the device can be dismantled for maintenance by removing both outer and inner tubular members 3 and 5 and lifting engagement wheel 89 and arm 91 in the direction indicated by arrow 100. Then the inner tubular member holder 11 can be moved out in the direction indicated by arrow 100*a* after which it can be lifted around the tubular wall and light system which will be described later.

The device which is illustrated also includes a tubular wall 101, preferably metallic such as aluminum, although any other suitable material could be used as will be appreciated by one skilled in the art, which is disposed at its lower end on a bottom support 103, as shown. Bottom support consists of a flanged unitary circular plate 105, having a flanged collar 107. In turn, bottom support is mounted on double flanged bottom support rest 113. Lower flange 115 is bolted to circular plate 7 at 117 and upper flange 119 is bolted to flanged collar 107 at 123. In the illustrated embodiment, a cylindrical container 125 is placed on bottom support within tubular wall 101. Since in the present embodiment, the device can also be used as a waste box, cylindrical container is in the form of a waste container. To ensure rotation of the inner tubular member 5 and to account for possible shocks when the device operates or is moved arout, enough space is provided between inner and outer tubular members 3 and 5.

As indicated above, the device according to the invention is intended to rotatably display lighted advertising material. For this purpose, the advertising material is provided in the form of sheets of translucid material 35 which are mounted on the interior face of transparent inner tubular member 5 by means of mounting strips 129 which are well known to those skilled in the art. In other words, once the mounting strips 129 are fixed against the inner face of transparent inner tubular member 5, such as by using an adhesive, riveting or the like, a sheet 35 of advertising material is slid under one of the wings 131, 133 of the strip, to be kept in place.

The lighting system which direct light against sheets 35 of translucid material is comprised of a plurality of fluorescent lamps 135 which are mounted in known manner exteriorly of tubular wall 101. Finally, a control box 137, in the embodiment which is illustrated, is fixed underneath flanged collar 107 by means of bolts 139. The control box has a switch 141 to start the motor and another switch 143 to switch on lamps 135. A cover 137 is provided to close waste box 125. Finally a cap 139 is mounted to cover the space between tubular wall 125 and inner tubular member 5 as well as the space between both tubular members 3 and 5.

To operate the device it is merely necessary to place a member of adds on the inner tubular member as described above and to switch on both switches.

One of the main advantage of the invention is to provide a publicity format which enables to easily change size of the advertising sheet without having to use any special tools.

It is understood that modifications are possible without departing from the spirit and scope of the invention as defined in the appended claims.

We claim:

1. Device for rotatably displaying advertising material, which comprises:

a base member, said base member comprising a circular plate provided with an upstanding continuous peripheral flange, a transparent outer tubular member, a lower portion of said transparent outer tubular member being mounted interiorly relative to said peripheral flange to be snugly engaged therewith, a transparent inner tubular member, a revolving inner tubular member holder, said revolving inner tubular member holder being ring shaped into an outer channel adapted to receive a lower end of said transparent inner tubular member, with said transparent inner tubular member being inwardly spaced from said transparent outer tubular member, a vertical guide mounted to enable the tubular member holder to continuously rotate around a central axis of said device, said ring shaped inner tubular member holder having an inner horizontal portion, said vertical guide protruding from an inner end of said horizontal portion, said inner horizontal portion extending into a downward angular portion which is terminated at an outer end of said outer channel, an articulated arm and driving wheel bracket fixedly mounted on said circular plate, and a driving wheel mounted on said articulated arm and driving wheel bracket to drivingly engage an underface of said horizontal portion, said driving wheel operatively connected to an electrical motor to rotate said ring shaped tubular member holder an said inner tubular member, a motor bracket mounted on said articulated arm and driving wheel bracket, said electrical motor disposed on said motor bracket, an arm articulately fixed at one end to said articulated arm and driving wheel bracket, the other end of said arm having means to mount a freely rotatable engagement wheel, and a coil spring disposed between said motor bracket and said articulated arm to bias said engagement wheel against an upper face of said inner horizontal portion of said ring shaped inner tubular member holder, means for mounting translucid advertising material on said transparent inner tubular member, and lighting means mounted to direct light against said transparent inner tubular member so as to enable advertising material mounted thereon to be observed through said transparent outer tubular member.

* * * * *